United States Patent [19]

Shinmura

[11] 4,194,751

[45] Mar. 25, 1980

[54] ROLLING TYPE ATHLETIC APPARATUS

[76] Inventor: Tomisaku Shinmura, No. 1343-3, Kobitomi-cho, Hamamatsu-shi, Shizuoka-ken, Japan

[21] Appl. No.: 925,841

[22] Filed: Jul. 18, 1978

[51] Int. Cl.[2] ..... A63C 17/14

[52] U.S. Cl. ..... 280/11.2; 280/11.21; 280/11.24

[58] Field of Search ..... 280/87.04, 11.24, 11.2, 280/11.19, 11.21, 205

[56] References Cited

U.S. PATENT DOCUMENTS

| | | | |
|---|---|---|---|
| 1,176,074 | 3/1916 | Malcolm | 280/11.24 |
| 3,330,571 | 7/1967 | Pierce | 280/87.04 R |

FOREIGN PATENT DOCUMENTS

| | | | |
|---|---|---|---|
| 753203 | 10/1933 | France | 280/11.24 |

*Primary Examiner*—Joseph F. Peters, Jr.
*Assistant Examiner*—Donn McGiehan
*Attorney, Agent, or Firm*—Holman & Stern

[57] ABSTRACT

This invention relates to novel rolling type athletic apparatus taking advantage of the characteristic of stilts which comprises a pair of vertical rods each consisting of two pipces telescopically connected to each other. The upper end of each vertical rod is bent to form a handle. Each rod is provided at its lower end with a wheel having a brake and a one-way clutch. A step is mounted on the upper portion of the wheel.

3 Claims, 5 Drawing Figures

ROLLING TYPE ATHLETIC APPARATUS

BACKGROUND OF THE INVENTION

1. Field of the Invention

The present invention relates to novel athletic apparatus taking advantage of the characteristic of stilts and permitting a wide variety of exercises.

2. Description of the Prior Art

As the athletic apparatus of this kind, there have been known stilts. Although the stilts have been greatly effective in building up the sense of physical equilibrium, they have not been suitable for athletic apparatus since they are simple in operation and permit no varied exercises.

SUMMARY OF THE INVENTION

It is, therefore, a main object of the present invention to provide novel sliding type athletic apparatus comprising a pair of vertical rods with their upper ends being bent to form handles, in which wheels each having a brake and a one-way clutch are mounted to the lower ends of the rods, and steps for placing feet are provided on the upper portion of the wheels.

Another object of the present invention is to make such apparatus small.

BRIEF DESCRIPTION ON THE DRAWINGS

Preferred embodiments of the present invention will now be described with reference to the drawing in which.

DETAILED DESCRIPTION OF THE INVENTION

Figure 1:
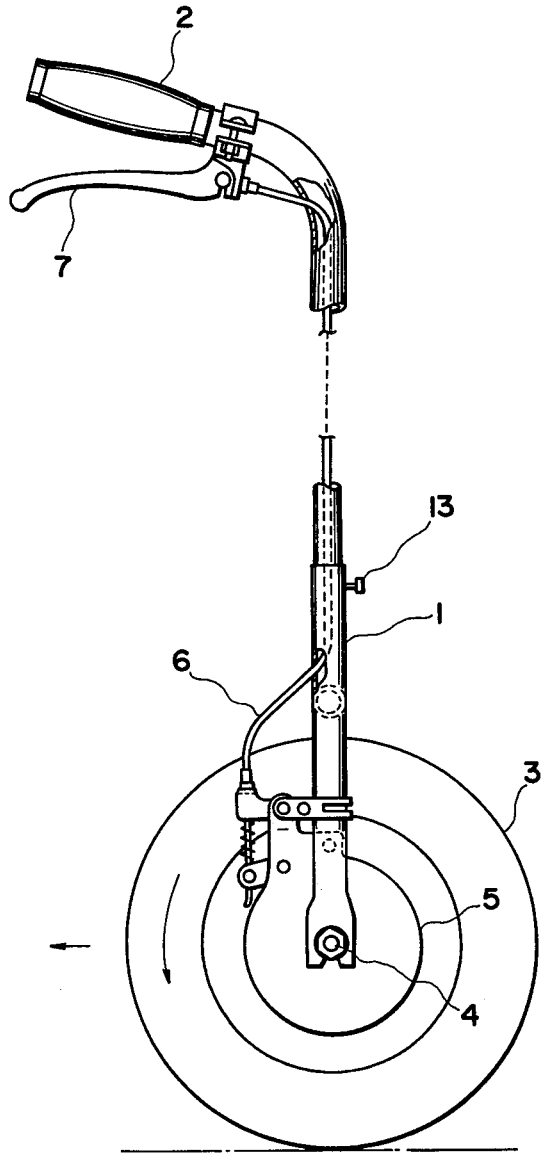
FIG. 1 is a plan view, partially cut away, illustrating one embodiment of the present invention.
Figure 2:
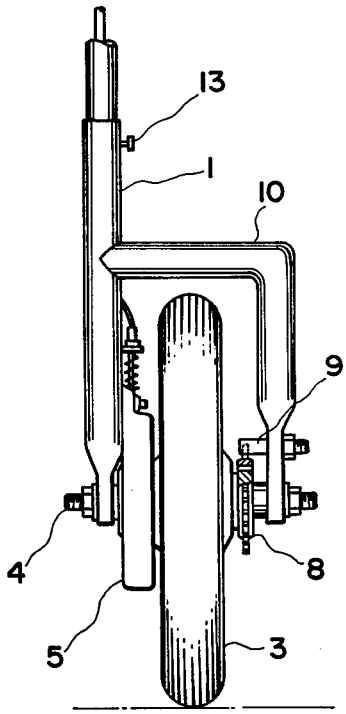
FIG. 2 is a side view, partially cut away, illustrating part of the same.

Referring first to FIGS. 1 and 2, and especially FIG. 1, numeral reference 1 deontes a pair of vertical rods each comprising two pipes telescopically connected to each other with their upper ends being bent to form handles 2. Explanation will hereinafter be given on one vertical rod for simplicity. The vertical rod is provided at its lower end with a wheel 3 which includes a hub 4 provided on its one side with a brake 5. In this embodiment, as the brake use is made of a drum brake for automobiles; however, this invention is not limited thereto. It is, therefore, understood that the brake of any type that can apply a braking force to a wheel may be employed. The brake 5 is actuiated by manipulation of a brake lever 7 connected thereto by way of a wire 6, said lever being attached to the handle 2. It will be noted that the wire 6 is passed through the inside of the vertical rod 1 to shorten its length as much as possible, since it otherwise will interfere with such manipulation. As shown in FIG. 2, numeral reference stands for a one-way clutch mounted on the other side of the hub 4. As the one-way clutch, use may be made of a free wheel comprising a combination of a rachet and a pawl. This one-way clutch is fixed at its inner side to the hub 4 and a stop pin 9 is inserted in between the teeth of a sprocket positioned on the outer side thereof, whereby the reversal of motion of the wheel is prevented. Numeral reference 10 denotes a step mounted on the upper portion of the wheel 3. In this embodiment, a L-shaped pipe 11 is fixed to the lower portion of the vertical rod 1 to use as the step its horizontal portion, and the hub 4 is supported at its end by the lower end thereof. Thus, the hub is supported at its both ends. Said stop pin 9 is also locked at the lower portion of the L-shaped pipe 11 by a nut 12. Numeral reference 13 stands for a lock nut for preventing expansion and contraction of the vertical rod.

Figure 3:
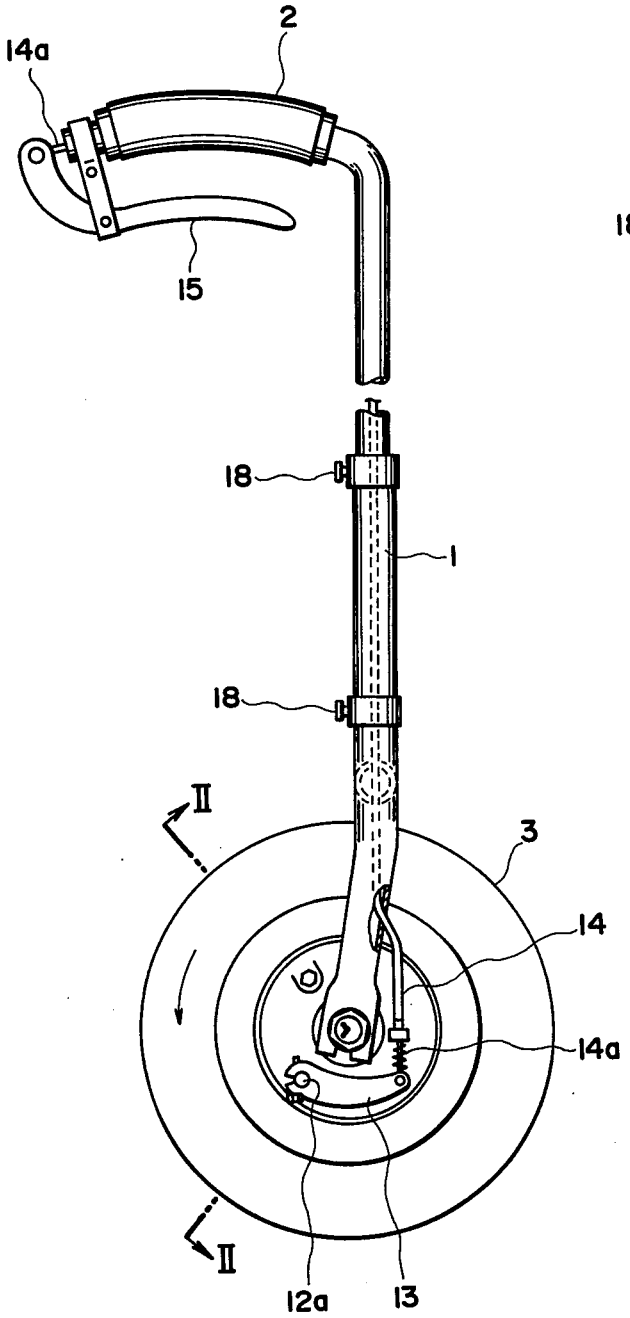
FIG. 3 is a plan view, partially cut away, illustrating another embodiment of the present invention.
Figure 4:
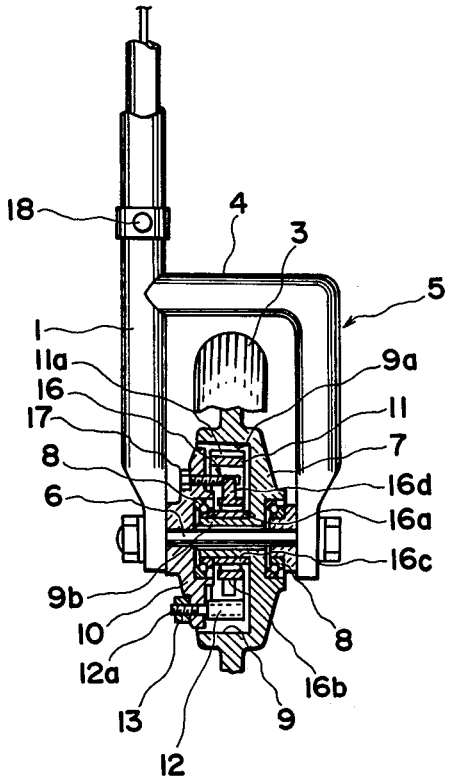
FIG. 4 is a sectional view taken along the line II-II of FIG. 3.
Figure 5:
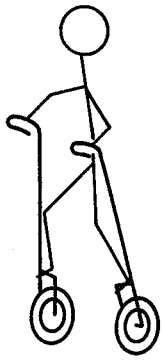
FIG. 5 is a sketch illustrative of the sliding type athletic apparatus of the present invention in use.

Referring now to FIGS. 3 and 4, and especially to FIG. 3, numeral reference 1 denotes a pair of vertical rods each comprising two pipes telescopically connected to each other with their upper ends being bent to form handles 2. Explanation will hereinafter be given on one vetical rod for simplicity. A wheel 3 is mounted on the lower end of the vertical rod 1, and a horizontally extending step 4 is fixed to the portion of the vertical rod 1 which lies just above said wheel 3. In this embodiment, a L-shaped pipe 5 is fixed to the lower portion of the vertical rod 1 to use its horizontal portion as the step 4, and the axle 6 of the wheel is supported at its one end by the lower end of the pipe 5 and at its other end by the lower end of the vertical rod 1.

Said wheel 3 is rotatively supported at its hub on the axle 6 through bearings 8 and 8, and an annularly recessed portion 9 is formed in said hub 7 in coaxial relation to the axis of the axle 6 and hence the axis of the wheel 3. The outer side of said recessed portion 9 is closed by a side plate 10 fitted over the axle and secured to the lower end portion of the vertical rod 1. A pair of semicircular brake shoes 11 are disposed in the recessed portion 9 to operate against the outer periphery 9*a* which forms a brake drum. The brake shoes 11 and a brake cam 12 are of a known inside expanding type braking device, in which one end of each brake shoe 11 is pivoted by pin (not shown) provided on the inner side of the plate 10, while the other end of each shoe is in abutting contact with the brake cam 12 rotatively attached to the side plate 10. The outer end of the brake cam 12 is also caused to project outwardly through the side plate 10. To this projection 12*a* is fixed a lever 13. The lever 13 is connected to a brake lever 15 pivotally mounted on the handle 12 by way of an inner cable 14*a* of a push-pull cable 14. Reference 11*a* denotes a brake lining secured to the outer periphery of the brake shoe. A one-way clutch 16 is mounted on the inner periphery 9*b* of the recessed portion 9. The one-way clutch 16 is similar to an ordinary one-way clutch interposed between the rear wheel sprocket and the rear axle of a bicycle etc., in which one of the opposite faces of an inner race 16*a* is secured to the inner periphery 9*b* of the recessed portion 9 and an outer race 16*b* surrounds the inner race with a series of needles 16*c* disposed between the races. As in the common form of bicycle hub one-way clutch, the needles are somewhat flattened in cross-section and the spacing between the races is less than the maximum needle diameter. This construction allows relative rotation between the inner and outer races in one direction only. The outer race 16*b* of the one-way clutch 16 is provided on its outer periphery with a number of radially extending portions 16*d* in engagement with member 17. These members which hold the outer race in position are threaded through the side plate 10, and are designed to be horizontally movable from the side plate 10 toward the inside of the recessed portion 9. In this connection, it will be noted that the one-way clutch is designed such that the wheel is permitted to rotate only at the time of the forward movement. Numeral reference 18 denotes a lock nut for preventing expansion and contraction of the vertical rod 1.

The operation of the sliding type athletic apparatus according to the present invention will now be described mainly with reference to the second embodiment mentioned hereinbefore. The handles 2 are first gripped to draw the brake levers 15, so that the levers 13 rotate in a counterclockwise direction (in FIG. 3) through the inner cables 14*a* of the push-pull cables 14, followed by rotation of the brake cams 12. The brake shoes 11 expand and rotate diametrically by said brake cams, so that the brake linings 11*a* come in abutting contact with the outer peripheries 9*a* of the recessed portions 9 to brake the wheels. In this state, one's feet are placed on both steps, and the brake levers 15 are gradually unloosed while taking one's balance, so that the levers 13, brake cams 12 and brake shoes 11 rotate in the direction reverse to that above mentioned. As a result, the brake lining 11*a* are out of engagement with the outer peripheries of the recessed portion 9*a* to release the braking of the wheels. At the same time, one wheel 3 is kicked rearward in the same manner as in roller skates, so that the wheel 3 is apt to rotate rearward. In this case, however, the one-way clutch 16 is actuated such that it is in engagement with the members 17 thereby to restrain such rotation. Hence, the other wheel 3 is caused to rotate forward due to the resultant counter action. When the wheel 3 rotates in the forward direction, the one-way clutch 16 is released while the one-way clutch and members 17 are located inwardly of the brake shoe 11, with the result that there in no fear that these components come in collision with the brake shoe 11 and the wall surface of the recessed portion 9. Thus, the sliding type athletic apparatus of the present invention can be caused to slide forward by alternately kicking a pair of the wheels 3 rearward in the same manner as aforesaid. Furthermore, the one-way clutch 16 is kept immovable even at the time of the rearward movement of the wheel 3 by removing the members 17. Therefore, a practiced hand can take a variety of exercises with this apparatus.

The sliding type athletic apparatus according to the present invention is effective in building up the sense of physical equilibrium and permitting a wide variety of exercises. Moreover, the apparatus can be made small by forming a recessed portion in one side of the hub of each wheel and arranging a braking device and a one-way clutch in said recessed portion thereby to restrain any increase in the horizontal width.

Depending upon height, each vertical rod can be adjusted by unloosing the lock nut.

Although preferred embodiments of the present invention have been shown in the foregoing specification, it will, of course, be understood that various modifications and changes may be made therein without departing from the invention. It is, therefore, intended that the following claims cover all such modifications and changes as may fall within the true spirit and scope of the present invention.

What is claimed is:

1. Rolling type athletic apparatus comprising support rod means, a handle at one end of said support rod means, an axle at the other end of said support rod means, a wheel rotatably mounted on said axle, a foot support associated with said support rod means adjacent said wheel, said wheel defining an annular recess surrounding said axle, said recess having an inner periphery and an outer periphery, a side plate means fixed relative to said support rod means, said side plate means having a portion adjacent said recess, brake shoe means located in said recess, said brake shoe means being carried by said side plate means, said outer periphery of said recess forming a brake drum for said brake shoe means, actuating means associated with said side plate means for moving said brake shoe means into and out of engagement with said outer periphery of said recess, operating means for said actuating means at said one end of said support rod means, linkage means connected between said operating means and said actuating means and one-way clutch means disposed within said recess between said brake shoe means and said inner periphery of said recess for permitting relative rotation between said wheel and said side plate means in one direction only.

2. The apparatus of claim 1 wherein said brake shoe means comprises a pair of substantially semicircular brake shoes each having one end pivotally connected to said side plate means and wherein said actuating means includes a brake cam carried by said side plate means internally of said recess, said brake cam engaging the other end of said brake shoes and a brake lever external to said recess, said brake lever being connected to said brake cam and to said linkage means.

3. The apparatus of claim 1 or claim 2 wherein said one-way clutch means comprises an inner race fixed relative to said wheel, an outer race fixed relative to said side plate means and a series of needles between said races.

* * * * *